US009984628B2

(12) United States Patent
Bae et al.

(10) Patent No.: US 9,984,628 B2
(45) Date of Patent: May 29, 2018

(54) ORGANIC LIGHT EMITTING DISPLAY DEVICE FOR COMPENSATING DETERIORATION OF A PIXEL AND METHOD OF DRIVING THE SAME

(71) Applicant: SAMSUNG DISPLAY CO., LTD., Yongin-si, Gyeonggi-do (KR)

(72) Inventors: Min-Seok Bae, Asan-si (KR); Su-Min Yang, Goyang-si (KR); Jin-Woo Park, Asan-si (KR); Dong-Won Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 15 days.

(21) Appl. No.: 15/087,588

(22) Filed: Mar. 31, 2016

(65) Prior Publication Data

US 2017/0084227 A1 Mar. 23, 2017

(30) Foreign Application Priority Data

Sep. 21, 2015 (KR) ..... 10-2015-0132984

(51) Int. Cl.

| | |
|---|---|
| ***G09G 3/32*** | (2016.01) |
| ***G09G 3/3275*** | (2016.01) |
| ***G09G 3/20*** | (2006.01) |
| ***G09G 3/3225*** | (2016.01) |
| ***G09G 3/3233*** | (2016.01) |

(52) U.S. Cl.

CPC ..... *G09G 3/3275* (2013.01); *G09G 3/2007* (2013.01); *G09G 3/3225* (2013.01); *G09G 3/3233* (2013.01); *G09G 2300/0819* (2013.01); *G09G 2300/0861* (2013.01); *G09G 2320/029* (2013.01); *G09G 2320/0233* (2013.01); *G09G 2320/0295* (2013.01); *G09G 2320/043* (2013.01); *G09G 2320/045* (2013.01); *G09G 2320/0693* (2013.01)

(58) Field of Classification Search

CPC ..... G09G 3/3233; G09G 2320/0233; G09G 2320/029; G09G 2320/0693; G09G 2320/043; G09G 2320/0285; G09G 2300/0819; G09G 3/3275

See application file for complete search history.

(56) References Cited

U.S. PATENT DOCUMENTS 6,229,508 B1 * 5/2001 Kane ..... G09G 3/3233 345/205
2003/0201727 A1 * 10/2003 Yamazaki ..... G09G 3/006 315/169.1
2015/0130866 A1 5/2015 Bae et al.

FOREIGN PATENT DOCUMENTS

KR 10-2015-0054124 A 5/2015

* cited by examiner

*Primary Examiner* — Xuemei Zheng
(74) *Attorney, Agent, or Firm* — Lewis Roca Rothgerber Christie LLP

(57) ABSTRACT

An organic light emitting display device includes a display panel including a plurality of pixels, a scan driver configured to provide a scan signal to the pixels, a data driver configured to provide a data signal to the pixels, a sensing circuit configured to sense a sensing current flowing through the pixels according to a sensing reference voltage applied to the pixels, and a controller configured to calculate a sensing current variation from the sensing current, and configured to adjust the sensing current variation based on a variation data of the pixels to compensate an input image data.

19 Claims, 9 Drawing Sheets

VMSET_MAP

| | | |
|---|---|---|
| 3.98V | · · · | 4.01V |
| · · · | · · · | · · · |
| 4.05V | · · · | 3.95V |

ORGANIC LIGHT EMITTING DISPLAY DEVICE FOR COMPENSATING DETERIORATION OF A PIXEL AND METHOD OF DRIVING THE SAME

CROSS REFERENCE TO RELATED APPLICATION

This application claims priority to, and the benefit of, Korean patent Application No. 10-2015-0132984 filed on Sep. 21, 2015, the entire disclosure of which is hereby incorporated by reference herein in its entirety.

BACKGROUND

1. Field

Example embodiments of the inventive concept relate to display devices, and a method of driving display devices, such as organic light emitting display devices.

2. Description of the Related Art

An organic light emitting diode (OLED) includes an organic layer between two electrodes, namely, between an anode and a cathode. Positive holes from the anode are combined with electrons from the cathode in the organic layer, which is between the anode and the cathode, to emit light. The OLED has a relatively wide viewing angle, a rapid response speed, is relatively thin, and low power consumption.

Generally, in an organic light emitting display device including the OLED, a deterioration of the OLED or a deterioration of a driving transistor (hereinafter, called "a deterioration of a pixel") can occur over time. The deterioration degree of the pixel increases as a driving time, or as an amount of driving current, increases. When the deterioration of the pixel occurs, the display quality can decrease, and afterimage can occur because a luminance of the deteriorated pixel decreases.

The organic light emitting display device applies a sensing reference voltage to the pixels, senses a sensing current flowing through the pixels according to the sensing reference voltage, and calculates a current variation to compensate the deterioration of the pixel. However, when the sensing current is sensed using the fixed sensing reference voltage, error of the current variation may occur because of a characteristic variation of the pixels. Accordingly, the organic light emitting display device might not accurately compensate the deterioration of the pixel.

SUMMARY

Example embodiments provide an organic light emitting display device capable of improving a display quality.

Example embodiments provide a method of driving the organic light emitting display device.

According to some example embodiments, an organic light emitting display device includes a display panel including a plurality of pixels, a scan driver configured to provide a scan signal to the pixels, a data driver configured to provide a data signal to the pixels, a sensing circuit configured to sense a sensing current flowing through the pixels according to a sensing reference voltage applied to the pixels, and a controller configured to calculate a sensing current variation from the sensing current, and configured to adjust the sensing current variation based on a variation data of the pixels to compensate an input image data.

The variation data may include a modeling voltage map including a modeling voltage corresponding to a modeling reference current flowing through one of the pixels, and a modeling data indicating a relationship between the modeling voltage and a current variation adjustment value.

The controller may include a current variation calculator configured to calculate the sensing current variation based on the sensing current, a current variation adjuster configured to convert the sensing current variation into an adjustment current variation based on the modeling voltage map and based on the modeling data, and a data compensator configured to compensate the input image data based on the adjustment current variation.

The current variation adjuster may be configured to derive a first modeling voltage corresponding to one of the pixels from the modeling voltage map, calculate a first current variation adjustment value corresponding to the first modeling voltage, calculate a second current variation adjustment value corresponding to the sensing reference voltage using the modeling data, and adjust the sensing current variation by an amount equal to a difference between the first current variation adjustment value and the second current variation adjustment value.

The controller further may include a stress data generator configured to generate a stress data by accumulatively storing the input image data.

The data compensator may be configured to compensate the input image data by an average value of a first compensation data, which is based on the adjustment current variation, and a second compensation data, which is based on the stress data.

The data compensator may be configured to compensate the input image data by one of a first compensation data, which is based on the adjustment current variation, and a second compensation data, which is based on the stress data.

The data compensator may be configured to compensate the input image data by the first compensation data when a grayscale value of the input image data is greater than a threshold grayscale value, and compensate the input image data by the second compensation data when the grayscale value of the input image data is less than or equal to the threshold grayscale value.

The modeling voltage map may further include modeling voltages, which includes the modeling voltage, each corresponding to one of the pixels.

The modeling voltage map may further include modeling voltages each corresponding to a group of adjacent ones of the pixels.

The modeling voltage may be stored as an offset value of the sensing reference voltage.

According to some example embodiments, a method of compensating deteriorations of pixels of an organic light emitting display device, the method includes deriving a modeling voltage map including modeling voltages that correspond to a modeling reference current flowing through respective ones of the pixels, deriving a modeling data indicating a relationship between the modeling voltages and current variation adjustment values, sensing a sensing current flowing through the pixels corresponding to a sensing reference voltage applied to the pixels, calculating a sensing current variation of the sensing current, converting the sensing current variation into an adjustment current variation based on the modeling voltage map and based on the modeling data, and compensating an input image data based on the adjustment current variation.

Converting the sensing current variation into the adjustment current variation may include deriving a first modeling voltage of the modeling voltages from the modeling voltage map, calculating a first current variation adjustment value corresponding to the first modeling voltage, calculating a second current variation adjustment value corresponding to the sensing reference voltage using the modeling data, and adjusting the sensing current variation by an amount equal to a difference between the first current variation adjustment value and the second current variation adjustment value.

The modeling voltage map includes the modeling voltages respectively corresponding to individual ones of the pixels.

The modeling voltage map may include the modeling voltages respectively corresponding to groups of the pixels.

The method may further include storing the modeling voltages as offset values of the sensing reference voltage.

The method may further include generating a stress data by accumulatively storing the input image data.

The input image data may be compensated by an average value of a first compensation data generated based on the adjustment current variation and a second compensation data generated based on the stress data.

The input image data may be compensated by one of a first compensation data generated based on the adjustment current variation, or a second compensation data generated based on the stress data.

The input image data may be compensated by the first compensation data when a grayscale value of the input image data is greater than a threshold grayscale value, and the input image data may be compensated by the second compensation data when the grayscale value of the input image data is less than or equal to the threshold grayscale value.

Therefore, an organic light emitting display device according to example embodiments adjusts a sensing current variation by using a modeling voltage map having modeling voltages at which a modeling reference current flowing through the pixels, and a modeling data indicating a relationship between a modeling voltage and a current variation adjustment value. Accordingly, the organic light emitting display device can accurately compensate a deterioration of a pixel.

In addition, a method of driving an organic light emitting display device according to example embodiments can improve a display quality of the organic light emitting display device.

BRIEF DESCRIPTION OF THE DRAWINGS

Exemplary embodiments will be described more fully hereinafter with reference to the accompanying drawings, in which various embodiments are shown.

DETAILED DESCRIPTION

Exemplary embodiments will be described more fully hereinafter with reference to the accompanying drawings, in which various embodiments are shown.

Figure 1:
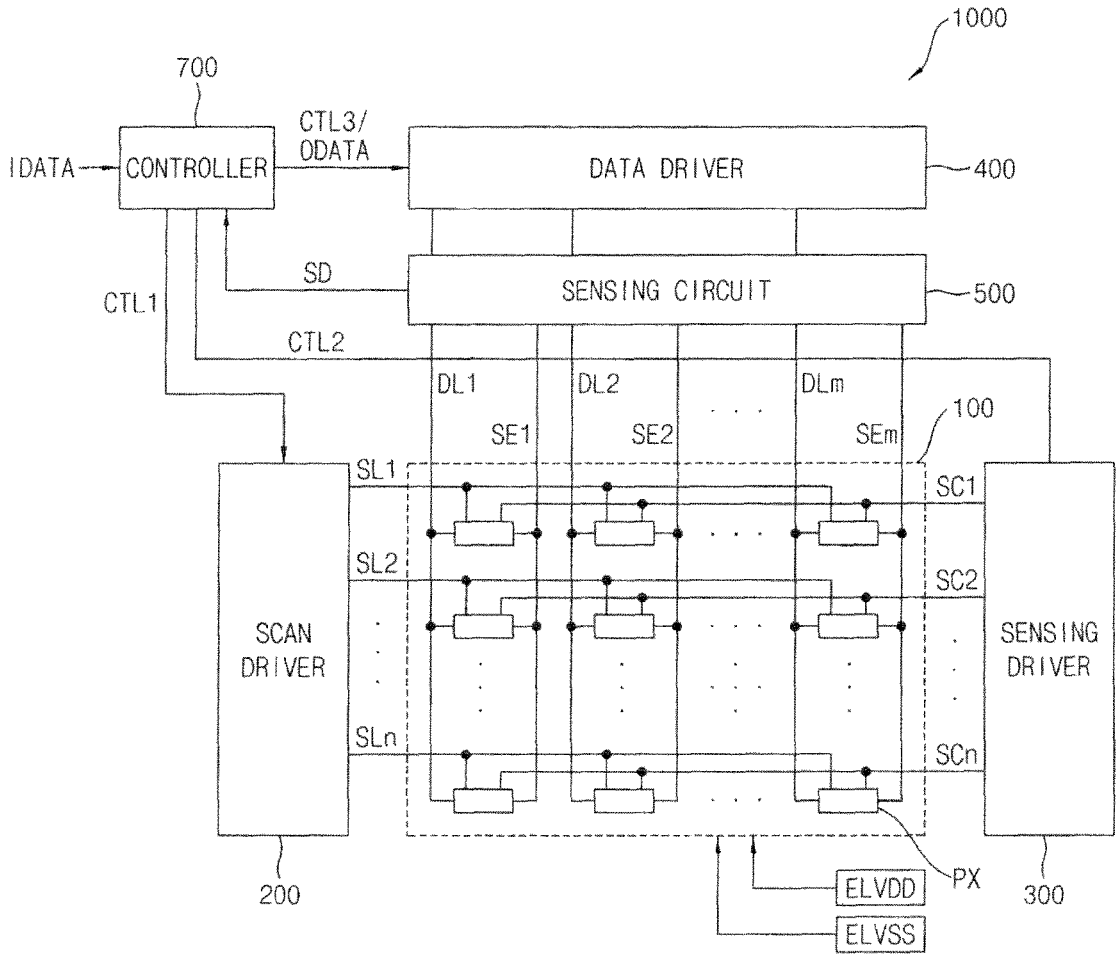
FIG. 1 is a block diagram illustrating an organic light emitting display device according to example embodiments.

FIG. 1 is a block diagram illustrating an organic light emitting display device according to example embodiments.

Referring to FIG. 1, an organic light emitting display device 1000 may include a display panel 100, a scan driver 200, a sensing driver 300, a data driver 400, a sensing circuit 500, and a controller 700.

The display panel 100 may include a plurality of pixels PX. For example, the display panel 100 may include n*m pixels PX (n and m being integers), as the pixels PX are arranged at locations corresponding to crossing points of the scan lines SL1 through SLn and the data lines DL1 through DLm.

The scan driver 200 may provide a scan signal to the pixels PX via the scan lines SL1 through SLn based on a first control signal CTL1.

The sensing driver 300 may provide a sensing control signal to the pixels PX via a plurality of sensing control lines SC1 through SCn based on a second control signal CTL2.

The data driver 400 may provide a data signal to the pixels PX via the data lines DL1 through DLm based on a third control signal CTL3.

The sensing circuit 500 may be connected to the pixels PX via a plurality of sensing lines SE1 through SEm. The sensing circuit 500 may sense a sensing current flowing through the pixels PX according to a sensing reference voltage VSET (see FIG. 2) applied to the pixels PX to thereby measure respective deterioration of each of the pixels PX. The sensing circuit 500 may provide a sensing data SD corresponding to the sensing current to the controller 700.

The controller 700 may receive the sensing data SD corresponding to the sensing current. The controller 700 may calculate a sensing current variation ΔI (see FIG. 3) from the sensing data SD, and may adjust the sensing current variation ΔI based on a variation data of the pixels PX to thereby compensate an input image data IDATA. In one example embodiment, the variation data may include a modeling voltage map MP/VMSET_MAP (see FIGS. 2 and 6) having modeling voltages VMSET (see [Equation 1] below) at which a modeling reference current (e.g., a predetermined modeling reference current) IM (see FIG. 5) flows through the pixels PX, and also having a modeling data MD (see FIG. 2) indicating a relationship between the modeling voltages VMSET and current variation adjustment values IA (see [Equation 1] below). Thus, the modeling voltages VMSET may be derived such that the same current (e.g., the modeling reference current IM) flows through the pixels PX when the modeling voltages VMSET are respectively applied to the pixels PX. The modeling voltages VMSET may be included in the modeling voltage map MP.

Also, the modeling data MD may be generated by one-dimensional modeling of the relationship between the modeling voltages VMSET and current variation adjustment values IA. Therefore, the controller 700 may adjust the sensing current variation ΔI using the modeling voltage map MP and the modeling data MD, thereby accurately compensating the deterioration of the pixels PX. Hereinafter, a structure of the controller 700 for compensating the deterioration of one of the pixels PX will be described in more detail with reference to the FIG. 3

In addition, the controller 700 may generate the first through third control signals CTL1 through CTL3 to respectively control the scan driver 200, the sensing driver 300, and the data driver 300.

Figure 2:
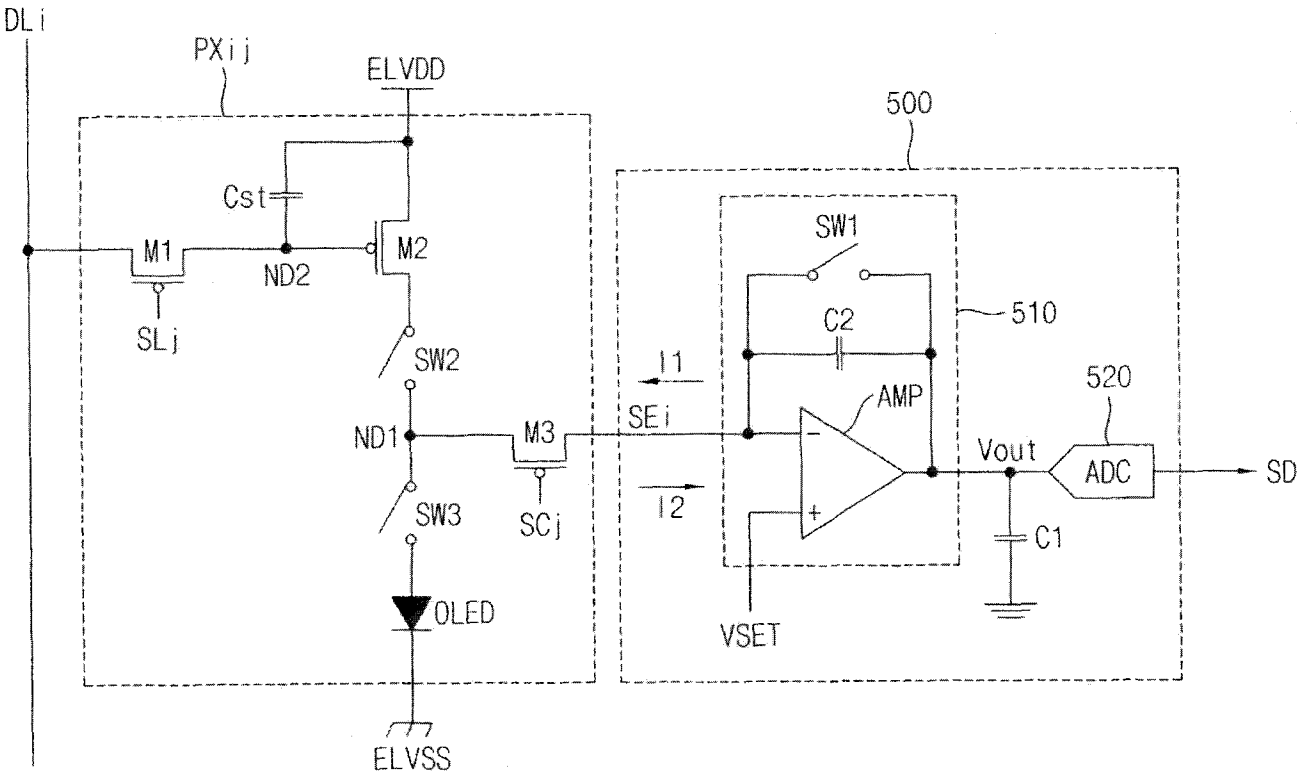
FIG. 2 is a circuit diagram illustrating an example of a pixel and a sensing circuit included in an organic light emitting display device of FIG. 1.

FIG. 2 is a circuit diagram illustrating an example of a pixel PX and a sensing circuit 500 included in an organic light emitting display device 1000 of FIG. 1.

Referring to FIG. 2, the illustrated pixel PXij may include a switching transistor M1, a driving transistor M2, a sensing transistor M3, a storage capacitor Cst, and an organic light emitting diode OLED. The pixel PXij may be connected to a (i)th data line DLi and a (i)th sensing line SEi, where i is an integer greater than 0.

The switching transistor M1 may be connected between the (i)th data line DLi and a second node ND2, and may be turned-on in response to a (j)th scan signal, where j is an integer greater than 0. The storage capacitor Cst may be connected between a first power voltage ELVDD and the second node ND2. When the switching transistor M1 is turned-on, the storage capacitor Cst may charge a voltage corresponding to the data signal provided from the (i)th data line DLi. The driving transistor M2 may provide a driving current corresponding to the charged voltage of the storage capacitor Cst to the organic light emitting diode OLED. The organic light emitting diode OLED may be connected between a first node ND1 and a second power voltage ELVSS, and may emit light corresponding to the driving current flowing between the first node ND1 and the second power voltage ELVSS. The sensing transistor M3 may be connected between an (i)th sensing line SEi and the first node ND1, and may be turned-on in response to a (j)th sensing control signal.

In one example embodiment, the pixel PXij may further include a second switch SW2 and a third switch SW3. The second switch SW2 may be connected between the driving transistor M2 and the first node ND1, and may be turned-off during a first sensing period. Here, the first sensing period may indicate a period for a sensing deterioration data of the organic light emitting diode OLED. In the first sensing period, while the second switch SW2 is turned-off, the third switch SW3 may be turned-on. In this case, a current path may be formed between the sensing circuit 500 and the second power voltage ELVSS, and then, a first sensing current I1 may flow through the (i)th sensing line SEi. Thus, the first sensing current I1 may flow from the sensing circuit 500 to the second power voltage ELVSS via the first node ND1.

The third switch SW3 may be connected between the first node ND1 and the organic light emitting diode OLED, and may be turned-off in a second sensing period. Here, the second sensing period may indicate a period for sensing variations of a threshold voltage and/or a mobility of the driving transistor M2. In the second sensing period, the second switch SW2 may be turned-on, and the third switch SW3 may be turned-off. In this case, a current path may be formed between the sensing circuit 500 and the first power voltage ELVDD, and then, a second sensing current I2 may flow through the (i)th sensing line SEi. Thus, the second sensing current I2 may flow from the first power voltage ELVDD to the sensing circuit 500 via the first node ND1.

Although the example embodiments of FIG. 2 describe that the pixel PXij includes the sensing line SEi separated from the data line DLi, a structure of the pixel PXij is not limited thereto. For example, the pixel PXij may include only the data line DLi while omitting the sensing line SEi, and the data line DLi may be used as the sensing line in sensing periods.

The sensing circuit 500 may include an integrator 510, a convertor (ADC) 520, and a memory device.

The integrator 510 may integrate a sensing current (i.e., the first sensing current I1 or the second sensing current I2) flowing through the (i)th sensing line SEi according to the sensing reference voltage VSET, and may output an output voltage Vout generated by integrating. The integrator 510 may include an amplifier AMP and a second capacitor C2. The amplifier AMP may include a first input terminal connected to the (i)th sensing line SEi, a second input terminal for receiving the sensing reference voltage VSET, and an output terminal connected to the converter 520. The second capacitor C2 may be connected between the first input terminal of the amplifier AMP and the output terminal of the amplifier AMP.

The integrator 510 may integrate the first sensing current I1 provided to the pixel PXij via the (i)th sensing line SEi in the first sensing period. In this case, the integrator 510 may operate as a current source. The integrator 510 may integrate the second sensing current I2 provided from the pixel PXij via the (i)th sensing line SEi in the second sensing period.

In one example embodiment, the integrator 510 may further include a first switch SW1 connected between the first input terminal of the amplifier AMP and the output terminal of the amplifier AMP. The first switch SW1 may be turned on during a reset period. The first switch SW1 may reset (or, initialize) the integrator 510 during the reset period. Thus, the first switch SW1 may discharge a stored voltage that is stored in the second capacitor C2 during the reset period.

In one example embodiment, the sensing circuit 500 may further include a first capacitor C1 that temporarily stores the output voltage Vout of the integrator 510. The first capacitor C1 may be connected between the output terminal of the amplifier AMP and a ground source, and may temporarily store the output voltage Vout during the first sensing period or the second sensing period.

The converter 520 may generate a sensing data SD based on the output voltage Vout of the integrator 510. For example, the converter 520 may include a comparator that compares the output voltage Vout of the integrator 510 and a setting voltage (or, the output voltage Vout and the sensing reference voltage VSET).

The sensing circuit 500 is illustrated by way of example in FIG. 2. The sensing circuit 500 is not limited thereto.

Figure 3:
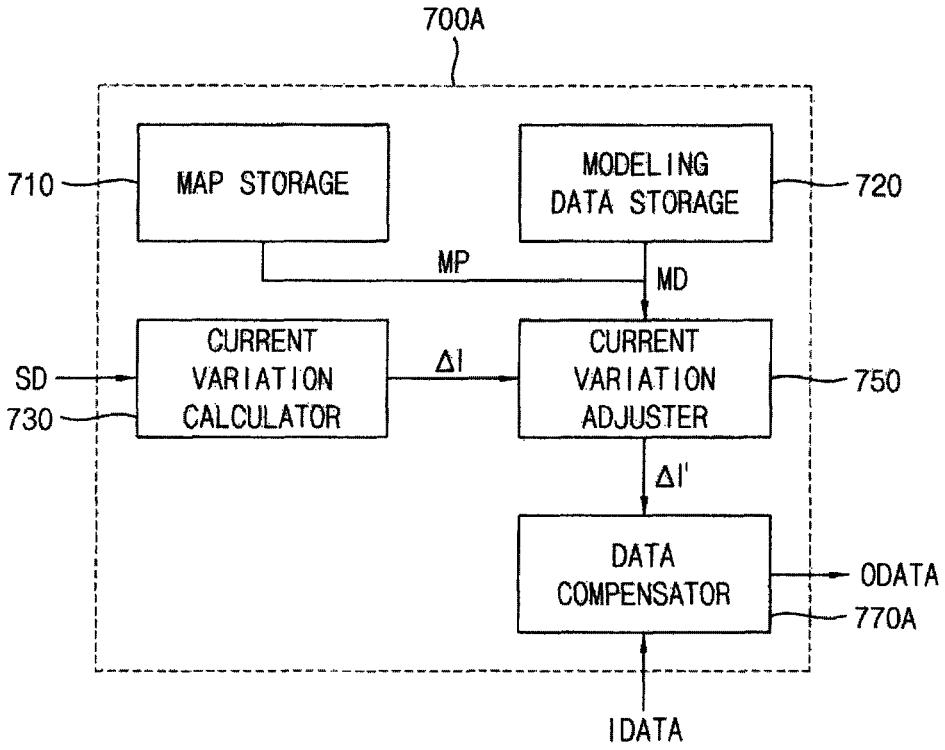
FIG. 3 is a block diagram illustrating one example of a controller included in an organic light emitting display device of FIG. 1.

FIG. 3 is a block diagram illustrating one example of a controller included in an organic light emitting display device 1000 of FIG. 1.

Referring to FIG. 3, the controller 700A may include a map storage 710, a modeling data storage 720, a current variation calculator 730, a current variation adjuster 750, and a data compensator 770A.

The map storage 710 may store a modeling voltage map MP having modeling voltages VMSET at which a modeling reference current (e.g., a predetermined modeling reference current) IM flowing through pixels. For example, in a manufacturing process of an organic light emitting display device 1000, the modeling voltages VMSET may be set such that the modeling reference current IM flows through the pixel when the modeling voltage VMSET is applied to the pixel PX. The modeling voltages VMSET may be stored in the map storage 710 as the modeling voltage map MP. The map storage 710 may include a non-volatile memory device. The non-volatile memory device may have a variety of aspects, such as the ability to maintain stored data even while power is not supplied, the ability to store mass data, low cost, etc. For example, the map storage 710 may include flash memory, erasable programmable read-only memory (EPROM), electrically erasable programmable read-only memory (EEPROM), phase change random access memory (PRAM), resistance random access memory (RRAM), nano floating gate memory (NFGM), polymer random access memory (PoRAM), magnetic random access memory (MRAM), ferroelectric random access memory (FRAM), etc.

The modeling data storage 720 may store a modeling data MD indicating a relationship between the modeling voltages VMSET and current variation adjustment values IA. For example, in the manufacturing process of the organic light emitting display device 1000, the modeling data MD may be generated by the one-dimensional modeling of the relationship between the modeling voltages VMSET and current variation adjustment values IA, and may be stored in the modeling data storage 720. In one example embodiment, the modeling data MD may include the relationship between the modeling voltages VMSET and current variation adjustment values IA according to [Equation 1] below:

$$IA=Ka*\text{VMSET}+Kb \quad \text{[Equation 1]}$$

where, IA is a current variation adjustment value, VMSET is a modeling voltage, Ka is a constant value (e.g., −0.1363), and Kb is a constant value (e.g., 0.7367).

The modeling data storage 720 may include a non-volatile memory device. In one example embodiment, the modeling data storage 720 may include flash memory, EPROM, EEPROM, PRAM, RRAM, NFGM, PoRAM, MRAM, FRAM, etc.

The current variation calculator 730 may calculate the sensing current variation ΔI from the sensing current I1 or I2. Here, the sensing current variation ΔI may correspond to a luminance degradation that occurs due to deterioration of a pixel PX, and may indicate a deterioration degree of the pixel PX. In one example embodiment, the current variation calculator 730 may calculate the sensing current variation ΔI by comparing sensing currents I1 or I2 of adjacent pixels PX. For example, a baseline (or, a reference line) may be set by connecting a first sensing current, which is measured at a first pixel among pixels PX in a deterioration area of a display panel 100, and a second sensing current, which is measured at a last pixel among the pixels PX in the deterioration area of the display panel 100. The sensing current variation ΔI may be set as a difference value corresponding to a difference between a sensing current I1 or I2 of the deteriorated pixel and the baseline. In another example embodiment, the current variation calculator 730 may calculate the sensing current variation ΔI by comparing the sensing current I1 or I2 of the deteriorated pixel, and a current of the pixel that is sensed at the time of initial driving of the display panel 100.

The current variation adjuster 750 may convert the sensing current variation ΔI into an adjustment current variation (e.g., an adjusted current variation) ΔI' based on the modeling voltage map MP and the modeling data MD. The current variation adjuster 750 may derive a first modeling voltage corresponding to a pixel from the modeling voltage map MP. The current variation adjuster 750 may calculate a first current variation adjustment value IA1 corresponding to the first modeling voltage VMSET1, and may calculate a second current variation adjustment value IA2 corresponding to the sensing reference voltage VSET using the modeling data MD. The current variation adjuster 750 may adjust the sensing current variation ΔI by a difference between the first current variation adjustment value IA1 and the second current variation adjustment value IA2.

[Example Embodiment 1]

In the present embodiment, the sensing reference voltage VSET is 4V, the sensing current variation ΔI is 10%, and the first modeling voltage VMSET1 corresponding to a target pixel, which is derived from the modeling voltage map MP, is 4.1V. In this case, the first current variation adjustment value IA1 calculated using the modeling data MD is about 0.177% (i.e., 0.177%=(−0.1363*4.1+0.7367)%), and the second current variation adjustment value IA2 is about 0.191% (i.e., 0.191%=(−0.1363*4+0.7367)%). Therefore, the adjustment current variation ΔI' is about 9.986% (i.e., 9.986%=(10+(0.177−0.191))%).

[Example Embodiment 2]

In the present embodiment, the sensing reference voltage VSET is 4V, the sensing current variation ΔI is 10%, and the first modeling voltage VMSET1 corresponding to a target pixel, which is derived from the modeling voltage map MP, is 3.9V. In this case, the first current variation adjustment value IA1 calculated using the modeling data MD is about 0.205% (i.e., 0.205%=(−0.1363*3.9+0.7367)%), and the second current variation adjustment value IA2 is about 0.191% (i.e., 0.191%=0.191%=(−0.1363*4+0.7367)%). Therefore, the adjustment current variation ΔI' is about 10.014% (i.e., 10.014%=(10+(0.205−0.191))%).

[Example Embodiment 3]

In the present embodiment, the sensing reference voltage VSET is 4V, the sensing current variation ΔI is 10%, and the first modeling voltage VMSET1 corresponding to a target pixel, which is derived from the modeling voltage map MP, is 4V. In this case, the sensing current variation ΔI is not needed to be adjusted because the first modeling voltage VMSET1 equals to the sensing reference voltage. Therefore, the adjustment current variation ΔI' is 10%.

The data compensator 770A may compensate the input image data IDATA based on the adjustment current variation ΔI'. For example, the data compensator 770A may calculate a luminance variation ΔL that occurs due to the deterioration of the pixel based on the adjustment current variation ΔI'. In one example embodiment, the data compensator 770A may calculate the luminance variation ΔL according to [Equation 2] below:

$$\Delta L=Ka*\Delta I'+Kb \quad \text{[Equation 2]}$$

where, ΔL is the luminance variation, Ka is a constant value, ΔI' is the adjustment current variation, and Kb is a constant value.

The data compensator 770A may derive a compensation data corresponding to the luminance variation ΔL and may generate an output image data ODATA by adjusting the input image data IDATA using the compensation data. For example, the data compensator 770A may derive a compensation data corresponding to the luminance variation ΔL using a look-up table, and may generate the output image data ODATA by using the input image data IDATA and the compensation data.

Figure 4:
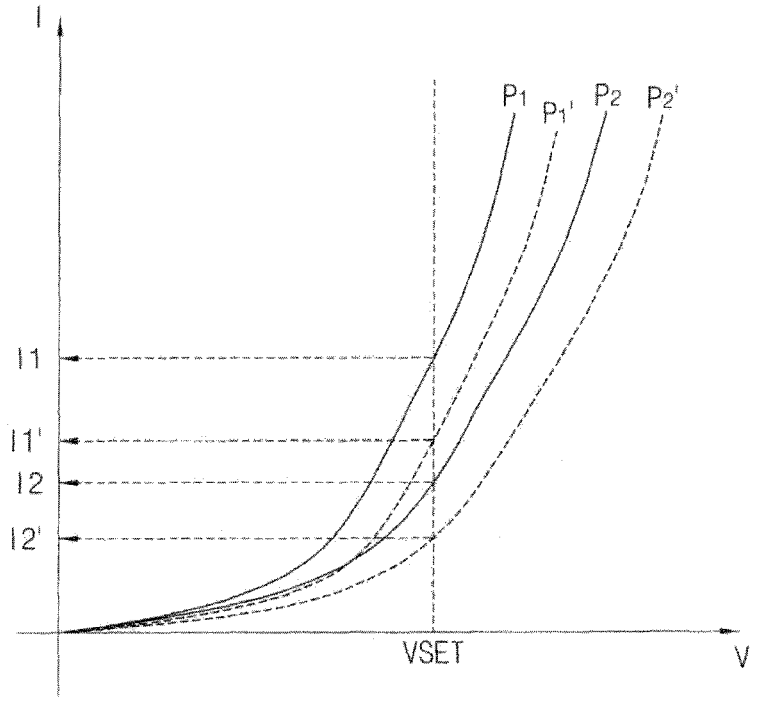
FIG. 4 is a graph illustrating a relationship between a sensing reference voltage and a sensing current according to a deterioration of a pixel.

FIG. 4 is a graph illustrating a relationship between a sensing reference voltage VSET and a sensing current I1 or I2 according to a deterioration of a pixel.

Referring to FIG. 4, a voltage-current characteristic curve may be changed as a pixel is deteriorated. For example, when a first pixel and a second pixel are not deteriorated, the first pixel may have a first voltage-current characteristic curve P1, and the second pixel may have a second voltage-current characteristic curve P2. When the first pixel and the second pixel are each deteriorated to substantially the same level, the first pixel may have a third voltage-current characteristic curve P1', and the second pixel may have a fourth voltage-current characteristic curve P2'.

As the first pixel is deteriorated, a sensing current I1 or I2 that is sensed when the sensing reference voltage VSET is applied to the first pixel may be changed from a first current I1 to a third current I1'. In addition, as the second pixel is deteriorated, a sensing current I1 or I2 that is sensed when the sensing reference voltage VSET is applied to the second pixel may be changed from a second current I2 to a fourth current I2'.

The first voltage-current characteristic curve P1 is different from the second voltage-current characteristic curve P2. However, the deteriorations of the pixels may be measured using the fixed sensing reference voltage VSET regardless of the characteristic curve. Accordingly, even if the first and second pixels are deteriorated to substantially the same level, a first sensing current variation (i.e., I1−I1', or ΔI1) corresponding to a difference value between the first current I1 and the third current I1' may be different from a second sensing current variation (i.e., I2−I2', or ΔI2) corresponding to a difference value between the second current I2 and the fourth current I2'. Therefore, the sensing current variation ΔI may be adjusted on the basis of the same magnitude of current (i.e., a modeling reference current).

Figure 5:
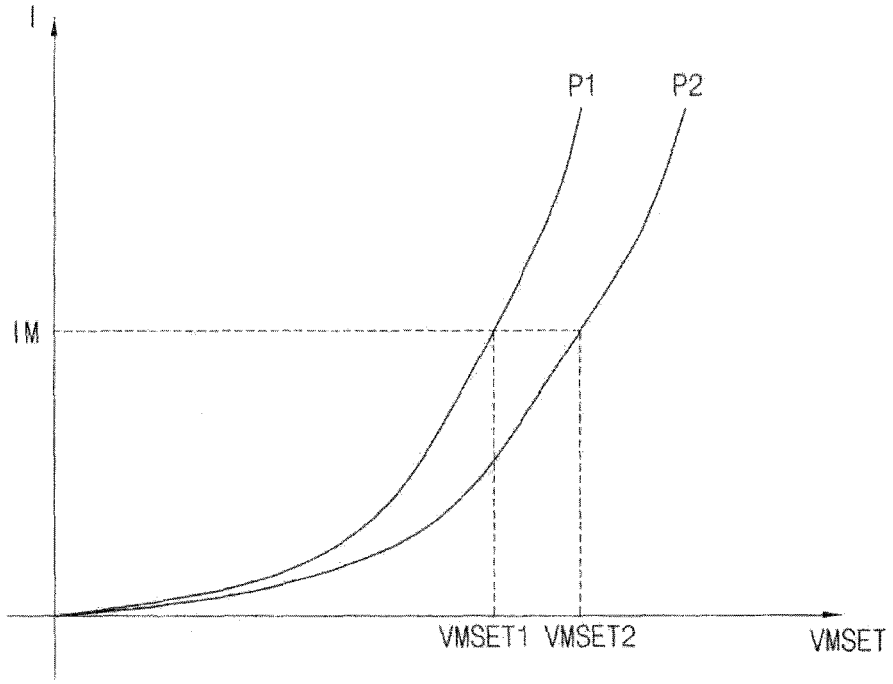
FIG. 5 is a graph for describing a method of deriving modeling voltages and a modeling voltage map.

FIG. 5 is a graph for describing a method of deriving modeling voltages VMSET and a modeling voltage map MP.

Referring to FIG. 5, a modeling voltage VMSET at which a modeling reference current IM flows through a pixel may be measured. For example, when a first modeling voltage VMSET1 is applied to a first pixel, the modeling reference current IM may be sensed. When a second modeling voltage VMSET2 is applied to a second pixel, the modeling reference current IM may be sensed. The measured modeling voltages VMSET for the pixels may be included in a modeling voltage map MP, and may be stored in the map storage 710.

Figures 6, 7:
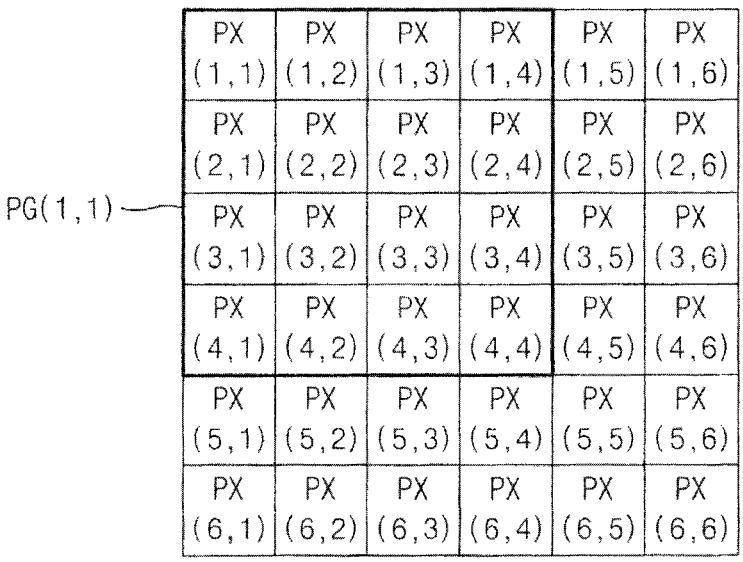
FIG. 6 is a diagram illustrating an example of a modeling voltage map.
FIG. 7 is a diagram illustrating an example in which a modeling voltage map of FIG. 6 includes modeling voltages corresponding to pixel groups.

FIG. 6 is a diagram illustrating an example of a modeling voltage map VMSET_MAP. FIG. 7 is a diagram illustrating an example that a modeling voltage map VMSET_MAP of FIG. 6 includes modeling voltages VMSET corresponding to pixel groups (e.g., groups of adjacent ones of the pixels).

Referring to FIGS. 6 and 7, a modeling voltage map VMSET_MAP may include modeling voltages VMSET corresponding to each of pixels, or may include modeling voltages VMSET corresponding to each of pixel groups.

In one example embodiment, the modeling voltage map VMSET_MAP may include the modeling voltages VMSET corresponding to the pixels. The modeling voltage map VMSET_MAP may include the modeling voltages VMSET respectively corresponding to the pixels, thereby accurately adjusting sensing current variation ΔI.

In another example embodiment, the modeling voltage map VMSET_MAP may include the modeling voltages VMSET corresponding to pixel groups. As shown in FIG. 7, adjacent pixels included in a 4-by-4 matrix may be grouped as one pixel group, and then the modeling voltage map VMSET_MAP may include the modeling voltages VMSET respectively corresponding to the different pixel groups. For example, the first pixel group PG(1,1) may include a (1-1)st pixel PX(1,1) through a (4-4)th pixel PX(4,4). A modeling voltage VMSET for the first pixel group PG(1,1) may be set to an average value of modeling voltages VMSET for the (1-1)st pixel PX(1,1) through the (4-4)th pixel PX(4,4), or may be set to one of the modeling voltages VMSET for the (1-1)st pixel through the (4-4)th pixel PX(4,4). Because the pixel group consists of adjacent pixels, deterioration degrees of the pixels included in the pixel group may be similar to each other. Therefore, in a high resolution organic light emitting display device 1000 of the present embodiment, the capacity of the map storage 710 can be reduced by storing the modeling voltages VMSET respectively corresponding to the pixel groups.

Although the example embodiment of FIG. 6 describe that the modeling voltages VMSET are stored as voltage values, the modeling voltages VMSET may be stored in various ways. For example, the modeling voltages VMSET may be stored as offset values of the sensing reference voltage VSET.

Figure 8:
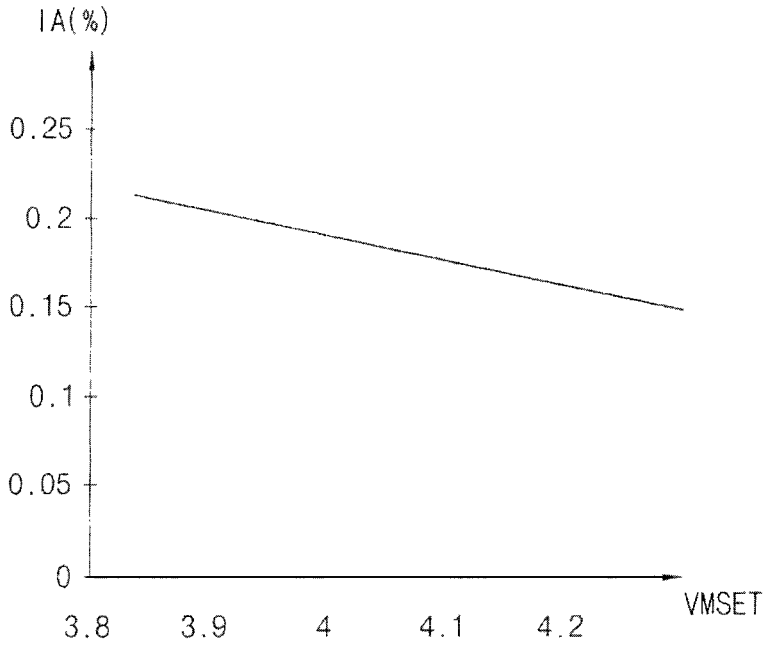
FIG. 8 is a graph illustrating an example of a modeling data indicating a relationship between a modeling voltage and a current variation adjustment value.

FIG. 8 is a graph illustrating an example of a modeling data MD indicating a relationship between a modeling voltage VMSET and a current variation adjustment value IA.

Referring to FIG. 8, a modeling data MD may be generated by the one-dimensional modeling of the relationship between a modeling voltage VMSET and a current variation adjustment value IA and may be stored in the modeling data storage 720. For example, the modeling data MD may include the relationship between the modeling voltages VMSET and current variation adjustment values IA according to [Equation 3] below:

$$IA=-0.1363*\text{VMSET}+0.7367 \quad \text{[Equation 3]}$$

where, IA is the current variation adjustment value, and VMSET is the modeling voltage.

Figure 9A:
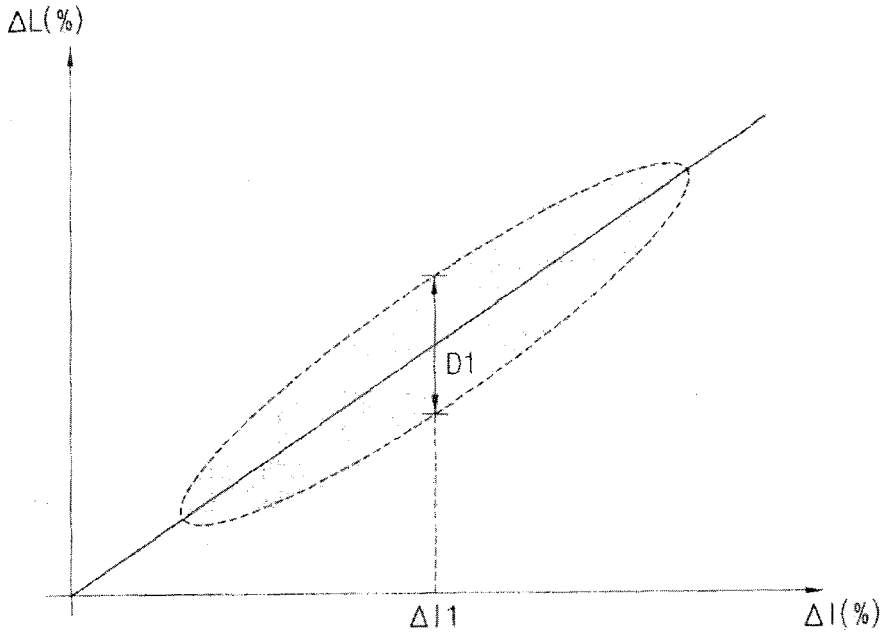
FIGS. 9A and 9B are graphs for describing an effect of an organic light emitting display device of FIG. 1.
Figure 9B:
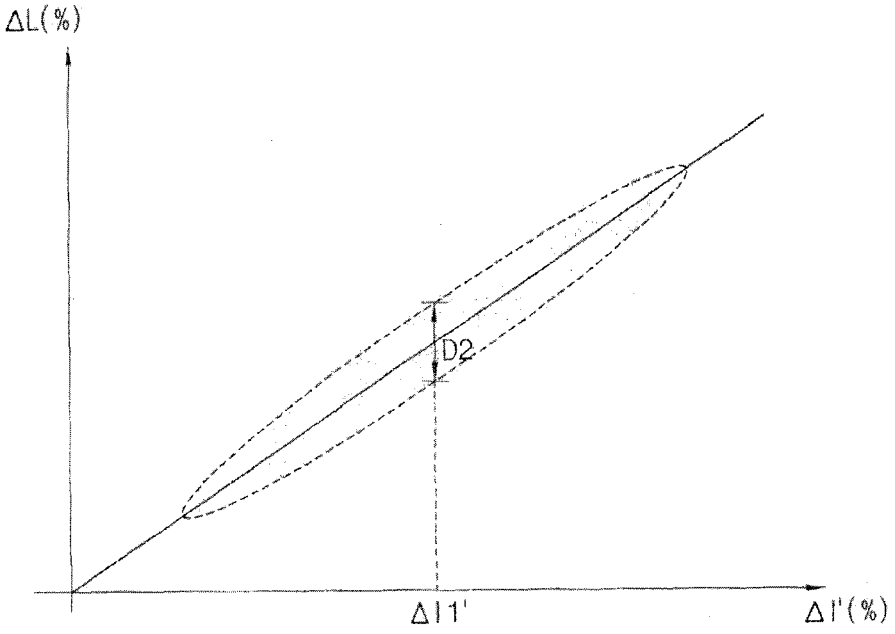

FIGS. 9A and 9B are graphs for describing an effect of an organic light emitting display device 1000 of FIG. 1.

Referring to FIGS. 9A and 9B, the organic light emitting display device 1000 may adjust a sensing current variation ΔI using a modeling voltage map MP/VMSET_MAP and a modeling data MD to generate an adjustment current variation ΔI', and then accurately compensate a deterioration of a pixel based on the adjustment current variation ΔI'.

As shown in FIG. 9A, the sensing current variation ΔI may be derived when the sensing reference voltage VSET applied to the pixel. Luminance variations ΔL of the pixels derived by the sensing current variation ΔI may have a relatively large error. For example, in a first sensing current variation ΔI1, a variation of luminance variations ΔL of the pixels may be a first variation value D1.

On the other hand, as shown in FIG. 9B, the adjustment current variation ΔI' may be generated by adjusting the sensing current variation ΔI on the basis of the modeling reference current IM. Luminance variations ΔL of the pixels derived by the adjustment current variation ΔI' may have a relatively small error. For example, in a first sensing current variation ΔI1', a variation of luminance variations ΔL of the pixels may be a second variation value D2 that is less than the first variation value D1.

Therefore, the organic light emitting display device 1000 may derive the luminance variation ΔL using the adjustment current variation ΔI', and may compensate the input image data IDATA, thereby accurately compensating the deterioration of the pixel by taking a characteristic variation of the pixels into account.

Figure 10:
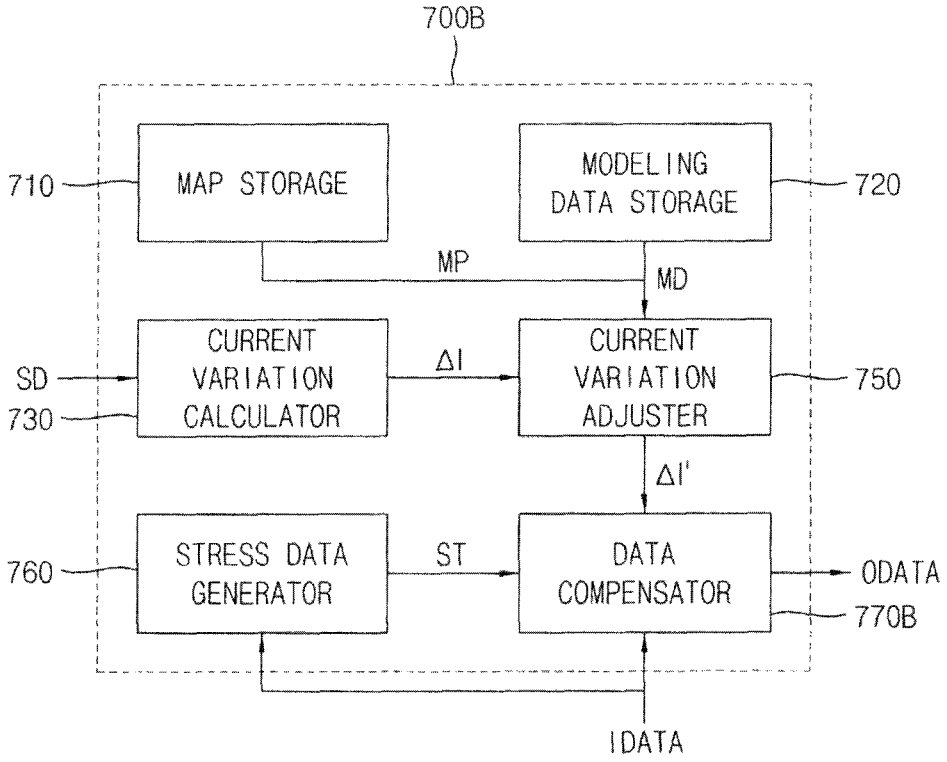
FIG. 10 is a block diagram illustrating another example of a controller included in an organic light emitting display device of FIG. 1.

FIG. 10 is a block diagram illustrating another example of a controller included in an organic light emitting display device 1000 of FIG. 1.

Referring to FIG. 10, the controller 700B may include a map storage 710, a modeling data storage 720, a current variation calculator 730, a current variation adjuster 750, a stress data generator 760, and a data compensator 770B. The controller 700B according to the present exemplary embodiment is substantially similar to the controller 700A of the exemplary embodiment described in FIG. 3, except that the stress data generator 760 is added. Therefore, the same reference numerals will be used to refer to the same or like parts as those described in the previous exemplary embodiment of FIG. 3, and any repetitive explanation concerning the above elements will be omitted.

The map storage 710 may store a modeling voltage map MP having modeling voltages VMSET at which a modeling reference current IM flowing through pixels.

The modeling data storage 720 may store a modeling data MD indicating a relationship between the modeling voltages VMSET and current variation adjustment values IA.

The current variation calculator 730 may calculate the sensing current variation ΔI from the sensing current I1 or I2.

The current variation adjuster 750 may convert the sensing current variation ΔI into an adjustment current variation ΔI' based on the modeling voltage map MP and the modeling data MD.

The stress data generator 760 may generate a stress data ST by accumulatively storing the input image data IDATA. Here, the stress data ST may include an accumulated driving data, an accumulated driving time, etc. In one example embodiment, the stress data generator 760 may include a volatile memory device in which the stress data ST is accumulatively stored while a display panel 100 is driven, and may include a non-volatile memory device for maintaining the stress data ST while power is not supplied.

The data compensator 770B may compensate the input image data IDATA based on the adjustment current variation ΔI'. The data compensator 770B may calculate a luminance variation ΔL that occurs due to the deterioration of the pixel based on the adjustment current variation ΔI', and may derive a first compensation data corresponding to the luminance variation ΔL. In addition, the data compensator 770B may derive a second compensation data corresponding to the stress data ST using a look-up table.

In one example embodiment, the data compensator 770B may compensate the input image data IDATA by an average value of a first compensation data, which is generated based on the adjustment current variation ΔI', and a second compensation data generated, which is based on the stress data ST. Thus, the data compensator 770B may reduce the compensation error that occurs in a method of compensating the deterioration of the pixel using the sensing current I1 or I2, and may improve a display quality by compensating the input image data IDATA using the average value of the first compensation data and the second compensation data.

In another example embodiment, the data compensator 770B may compensate the input image data IDATA by one of a first compensation data, which is generated based on the adjustment current variation ΔI', and a second compensation data, which is generated based on the stress data ST. The data compensator 770B may select one of the first compensation data and the second compensation data based on a grayscale value of the input image data IDATA to compensate the input image data IDATA. For example, when the input image data IDATA corresponds to a low grayscale region, a luminance may be relatively largely changed as a magnitude of the sensing current I1 or I2 is changed. Therefore, the data compensator 770B may compensate the input image data IDATA by the first compensation data when the grayscale value of the input image data IDATA is greater than a threshold grayscale value (e.g., a predetermined threshold grayscale value). On the other hand, the data compensator 770B may compensate the input image data IDATA by the second compensation data when the grayscale value of the input image data IDATA is less than, or equal to, the threshold grayscale value.

Figure 11:
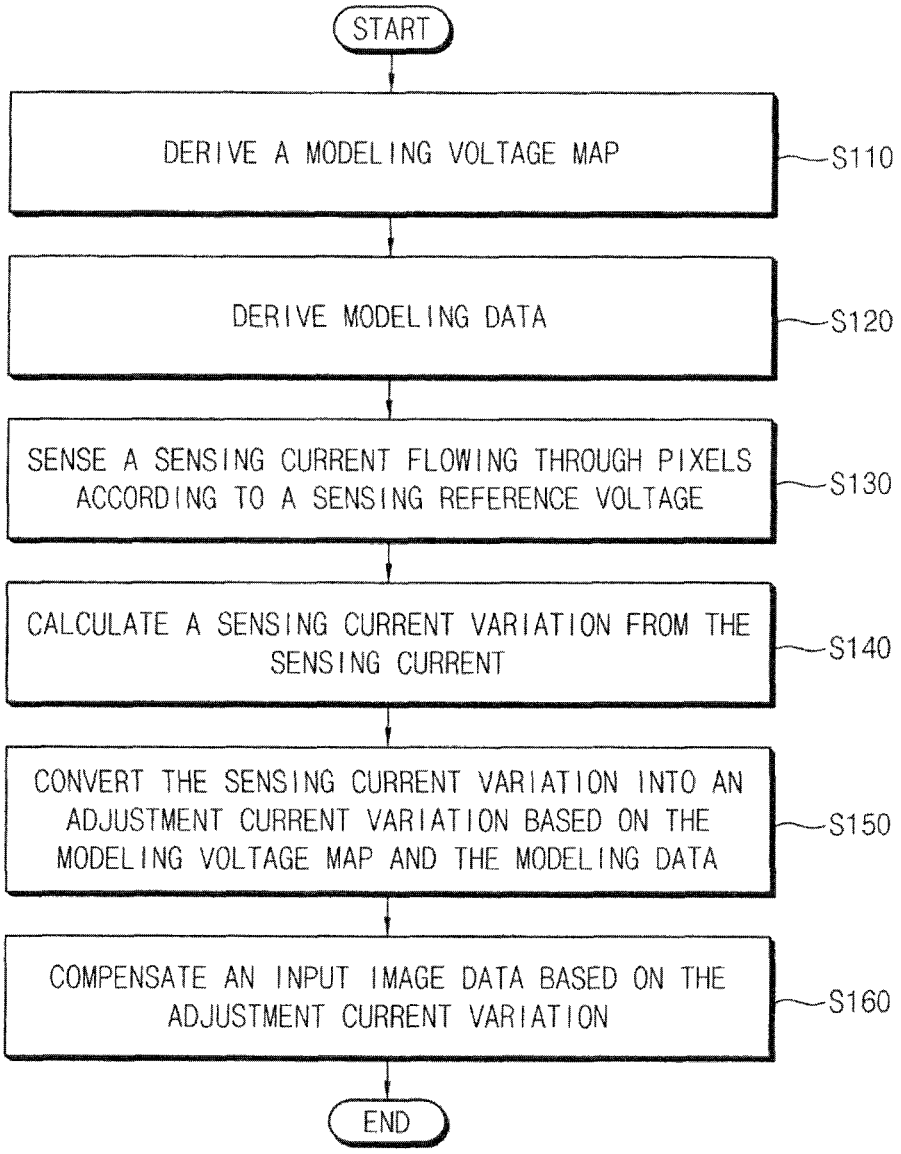
FIG. 11 is a flow chart illustrating a method of driving an organic light emitting display device according to example embodiments.

FIG. 11 is a flow chart illustrating a method of driving an organic light emitting display device 1000 according to example embodiments.

Referring to FIG. 11, a modeling voltage map MP/VMSET_MAP, which has modeling voltages VMSET at which a modeling reference current (e.g., predetermined modeling reference current) IM flowing through the pixels, may be derived (S110). For example, in the a manufacturing process of an organic light emitting display device 1000, the modeling voltages VMSET may be set such that the modeling reference current IM flows through the pixel when the modeling voltage VMSET is applied to the pixel. The modeling voltages VMSET may be stored in the map storage 710 as the modeling voltage map MP. In one example embodiment, the modeling voltage map MP may include the modeling voltages VMSET relatively corresponding to the pixels. In another example embodiment, the modeling voltage map MP may include the modeling voltages VMSET relatively corresponding to groups of adjacent pixels (e.g., the pixel groups). In one example embodiment, the modeling voltages VMSET may be stored as offset values of the sensing reference voltage VSET.

A modeling data MD, which indicates a relationship between the modeling voltages VMSET and current variation adjustment values IA, may be derived (S120). For example, in the manufacturing process of the organic light emitting display device 1000, the modeling data MD may be generated by the one-dimensional modeling of the relationship between the modeling voltages VMSET and current variation adjustment values IA, and may be stored in the modeling data storage 720.

The sensing current I1 or I2, which flows through the pixels according to a sensing reference voltage VSET applied to the pixels, may be sensed (S130).

A sensing current variation ΔI from the sensing current I1 or I2 may be calculated (S140). In one example embodiment, the sensing current variation ΔI may be calculated by comparing sensing currents I1 or I2 of adjacent pixels. In another example embodiment, the sensing current variation ΔI may be calculated by comparing the sensing current I1 or I2 of a deteriorated pixel, and a current sensed at the time of initial driving of a display panel 100.

The sensing current variation ΔI may be converted into an adjustment current variation ΔI' based on the modeling voltage map MP and the modeling data MD (S150). In one example embodiment, to convert the sensing current variation ΔI into the adjustment current variation ΔI', a first modeling voltage VMSET corresponding to one of the pixels from the modeling voltage map MP may be derived, a first current variation adjustment value IA1 corresponding to the first modeling voltage VMSET1, and a second current variation adjustment value IA2 corresponding to the sensing reference voltage VSET, may be calculated using the modeling data MD, and the sensing current variation ΔI may be adjusted by a difference between the first current variation adjustment value IA1 and the second current variation adjustment value IA2 to calculate a current variation. Because an operation of converting the sensing current variation ΔI into the adjustment current variation ΔI' is described above, duplicated descriptions will be omitted.

An input image data IDATA may be compensated based on the adjustment current variation ΔI' (S160). A compensation data corresponding to the luminance variation ΔL may be derived, and an output image data ODATA may be generated by adjusting the input image data IDATA using the compensation data. In one example embodiment, the input image data IDATA may be compensated by an average value of a first compensation data, which is generated based on the adjustment current variation ΔI', and a second compensation data, which is generated based on the stress data ST. In one example embodiment, the input image data IDATA may be compensated by one of a first compensation data, which is generated based on the adjustment current variation ΔI', and a second compensation data, which is generated based on the stress data ST. For example, the input image data IDATA may be compensated by the first compensation data when a grayscale value of the input image data IDATA is greater than a threshold grayscale value, and the input image data IDATA may be compensated by the second compensation data when the grayscale value of the input image data IDATA is less than or equal to the threshold grayscale value.

Therefore, the method of driving the organic light emitting display device 1000 may accurately compensate the deterioration of the pixel, and may improve the display quality.

Although the example embodiments describe that a sensing circuit 500 is separated from a data driver 300, the present invention is not limited thereto. For example, the sensing circuit and the data driver may be implemented in one integrated circuit (IC) chip.

The present inventive concept may be applied to an electronic device having the organic light emitting display device 1000. For example, the present inventive concept may be applied to a cellular phone, a smart phone, a smart pad, a personal digital assistant (PDA), etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims and as defined by the functional equivalents of the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims and their equivalents.

What is claimed is:

1. An organic light emitting display device comprising:

a display panel comprising a plurality of pixels;

a scan driver configured to provide a scan signal to the pixels;

a data driver configured to provide a data signal to the pixels;

a sensing circuit configured to sense a sensing current flowing through one of the pixels according to a predetermined sensing reference voltage applied to the pixels; and a controller configured to calculate a variation of the sensing current as time passes, configured to adjust the variation of the sensing current based on a modeling voltage map and a modeling data, and configured to compensate an input image data based on the adjusted variation of the sensing current, wherein the modeling voltage map includes modeling voltages corresponding to respective ones of the pixels, a predetermined modeling reference current flowing through respective ones of the pixels when the modeling voltages are respectively applied to the pixels, and wherein the modeling data indicates a relationship between the modeling voltages and respective sensing current variation adjustment values.

2. The display device of claim 1, wherein the controller comprises:

a current variation calculator configured to calculate the variation of the sensing current as time passes;

a current variation adjuster configured to adjust the variation of the sensing current based on the modeling voltage map and the modeling data; and a data compensator configured to compensate the input image data based on the adjusted variation of the sensing current.

3. The display device of claim 2, wherein the current variation adjuster is configured to:

derive a first modeling voltage corresponding to one of the pixels from the modeling voltage map;

calculate a first sensing current variation adjustment value corresponding to the first modeling voltage;

calculate a second sensing current variation adjustment value corresponding to the predetermined sensing reference voltage using the modeling data; and adjust the variation of the sensing current by an amount equal to a difference between the first sensing current variation adjustment value and the second sensing current variation adjustment value.

4. The display device of claim 2, wherein the controller further comprises a stress data generator configured to generate a stress data by accumulatively storing the input image data.

5. The display device of claim 4, wherein the data compensator is configured to compensate the input image data by an average value of a first compensation data, which is based on the adjusted variation of the sensing current, and a second compensation data, which is based on the stress data.

6. The display device of claim 4, wherein the data compensator is configured to compensate the input image data by one of a first compensation data, which is based on the adjusted variation of the sensing current, and a second compensation data, which is based on the stress data.

7. The display device of claim 6, wherein the data compensator is configured to:

compensate the input image data by the first compensation data when a grayscale value of the input image data is greater than a threshold grayscale value; and compensate the input image data by the second compensation data when the grayscale value of the input image data is less than or equal to the threshold grayscale value.

8. The display device of claim 1, wherein the modeling voltages each correspond to one of the pixels.

9. The display device of claim 1, wherein the modeling voltages each correspond to a group of adjacent ones of the pixels.

10. The display device of claim 1, wherein one of the modeling voltages is stored as an offset value of the predetermined sensing reference voltage.

11. A method of compensating deteriorations of pixels of an organic light emitting display device, the method comprising:

deriving a modeling voltage map comprising modeling voltages corresponding to respective ones of the pixels, a predetermined modeling reference current flowing through respective ones of the pixels when the modeling voltages are respectively applied to the pixels;

deriving a modeling data indicating a relationship between the modeling voltages and respective sensing current variation adjustment values;

sensing a sensing current flowing through one of the pixels corresponding to a predetermined sensing reference voltage applied to the pixels;

calculating a variation of the sensing current as time passes;

adjusting the variation of the sensing current based on the modeling voltage map and the modeling data; and compensating an input image data based on the adjusted variation of the sensing current.

12. The method of claim 11, wherein adjusting the variation of the sensing current comprises:

deriving a first modeling voltage of the modeling voltages from the modeling voltage map;

calculating a first sensing current variation adjustment value and a second sensing current variation adjustment value respectively corresponding to the first modeling voltage and the predetermined sensing reference voltage using the modeling data; and adjusting the variation of the sensing current by an amount equal to a difference between the first sensing current variation adjustment value and the second sensing current variation adjustment value to generate an adjustment current variation.

13. The method of claim 11, wherein the modeling voltages respectively correspond to individual ones of the pixels.

14. The method of claim 11, wherein the modeling voltages respectively correspond to groups of the pixels.

15. The method of claim 11, further comprising storing the modeling voltages as offset values of the predetermined sensing reference voltage.

16. The method of claim 11, further comprising generating a stress data by accumulatively storing the input image data.

17. The method of claim 16, wherein the input image data is compensated by an average value of a first compensation data generated based on the adjusted variation of the sensing current and a second compensation data generated based on the stress data.

18. The method of claim 16, wherein the input image data is compensated by one of a first compensation data generated based on the adjusted variation of the sensing current, or a second compensation data generated based on the stress data.

19. The method of claim 18, wherein the input image data is compensated by the first compensation data when a grayscale value of the input image data is greater than a threshold grayscale value, and wherein the input image data is compensated by the second compensation data when the grayscale value of the input image data is less than or equal to the threshold grayscale value.

* * * * *